United States Patent [19]

Tomita et al.

[11] Patent Number: 4,888,263

[45] Date of Patent: Dec. 19, 1989

[54] COLOR TONER FOR ELECTROPHOTOGRAPHY

[75] Inventors: Masami Tomita; Yoshihiro Nomura, both of Numazu; Noriaki Ide, Fuji; Kazumi Ohtaki, Numazu, all of Japan

[73] Assignee: Ricoh Co., Ltd., Tokyo, Japan

[21] Appl. No.: 939,382

[22] Filed: Dec. 8, 1986

[30] Foreign Application Priority Data

Dec. 19, 1985 [JP] Japan ..... 60-287317
Jan. 22, 1986 [JP] Japan ..... 61-10218

[51] Int. Cl.[4] ..... G03G 9/00
[52] U.S. Cl. ..... 430/106; 430/110
[58] Field of Search ..... 430/110, 106

[56] References Cited

U.S. PATENT DOCUMENTS

| | | | |
|---|---|---|---|
| Re. 27,912 | 2/1974 | Miller | 430/106.6 |
| 3,888,678 | 6/1975 | Bailey | 430/110 |
| 3,983,045 | 9/1976 | Jugle et al. | 430/110 |
| 4,145,300 | 3/1979 | Hendriks | 430/110 X |
| 4,391,893 | 7/1983 | Hendriks | 430/110 X |

FOREIGN PATENT DOCUMENTS

| | | | |
|---|---|---|---|
| 2815887 | 10/1978 | Fed. Rep. of Germany | 430/110 |

*Primary Examiner*—J. David Welsh
*Attorney, Agent, or Firm*—Flynn, Thiel, Boutell & Tanis

[57] ABSTRACT

This invention relates to a color toner for electrophotography containing a coloring agent and a binder resin as the main components, said coloring agent comprising at least one of the anthraquinone derivatives expressed by the following general formula (I),

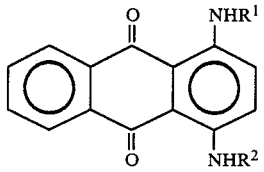

(I)

wherein $R^1$ represents hydrogen or an alkyl group having at least 6 carbon atoms and $R^2$ represents hydrogen, an alkyl group having at least 6 carbon atoms or phenyl group.

This invention further relates to a color toner for electrophotography containing a coloring agent and a binder resin as the main components, in addition to said anthraquinone derivatives of the general formula (I), said coloring agent further comprising at least one of the compounds expressed by the following chemical formulas (II) and (III):

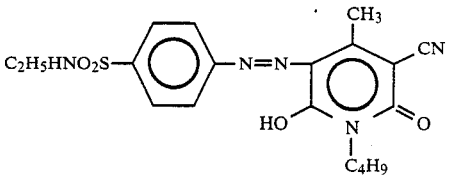

(II)

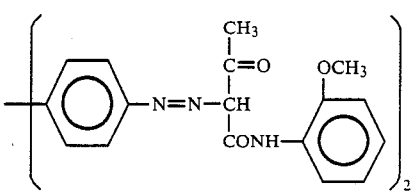

(III)

23 Claims, No Drawings

COLOR TONER FOR ELECTROPHOTOGRAPHY

BACKGROUND OF THE INVENTION

1. Field of the Invention

This invention relates to a color toner for electrophotography, particularly, a color toner containing a specific compound as a coloring agent.

2. Description of the Prior Art

There are two types of systems for developing electrostatic latent images formed on an electrophotographic photosensitive material, electrostatic recording material and the like, one of which uses a liquid developer (wet type developing method), and the other of which uses a dry developer such as a one component type toner having a coloring agent dispersed in a binder resin or a two component type toner comprising a mixture of said one component type toner with a solid carrier (dry type developing method). These systems have merits and demerits. Recently, the dry type developing method, particularly a two component type developer has been generally used.

A toner conventionally used for the two component type developer is prepared by admixing a coloring agent (dye or pigment) with a binder resin, kneading the resultant admixture by a two-roll mill or other means in the melted state, and powdering the kneaded mixture to a particle size of 1~30 μm. The toner thus prepared is mixed with a carrier material having a particle size of 50~100 μm, thereby producing a developer used for developing an electrostatic latent image.

In order to use the toner and carrier for developing an electrostatic latent image, they must be constantly triboelectrified in a copier, and the triboelectrified toner having a stable electrified amount is then applied to the electrostatic latent image. Therefore, it is necessary for imparting the desired triboelectricity (i) to appropriately select a binder resin and/or a coloring agent for a toner, or (ii) to add a charge controlling agent (an agent for controlling the electricity of a toner against the friction with a carrier) to a toner.

However, even today, the selection of an appropriate binder resin in the above step (i) can not be satisfactorily carried out. For example, it is known to use a chlorinated paraffin, unsaturated polyester and the like as a binder resin for making a toner negatively electrified, or to use the specific polyester resin having a kind of cross-linking structure (reaction product of non-linear low melting aromatic resin with chelated salicylic acid), but these resins do not have a molecular weight suitable for a binder resin, thus not having appropriate heat-properties (appropriate melting properties by heat roll during fixing) desired for a toner. Therefore, these resins provide various problems such as copy delivery miss caused by the winding of a copy about a heat roll, and "off-set" phenomenon that a developed image becomes unclear because a toner on a copy paper is transferred to the surface of a roller.

In the selection of a coloring agent in the above step (i), examples of the conventional coloring agents proposed for a toner of a liquid developer include various kinds of dyes, for example, anthraquinone derivatives (ones having a long chain alkyl phenyl group, a long chain alkyl amino group or the like, laked or electrified ones, ones produced by reacting with a surface active agent, and acidic group containing water-soluble dyes having an anthraquinone group introduced) and the like. However, a satisfactory effect can not be achieved for a dry type toner, particularly a toner of a two-component type developer by these conventional dyes such as anthraquinone derivatives.

On the other hand, examples of the conventionally known charge controlling agents used in the step (ii) include an agent for imparting a positive charge to a toner such as a nigrosine type dye and an agent for imparting a negative charge to a toner such as a chromium-containing monoazo complex, metal complex of salicylic acid, chromium-containing salicylic acid compound complex, chlorine-containing organic dye (Copper Phthalocyanine Green, chlorine-containing monoazo dye), metal-containing dye of phthalocyanine type dye, nitrohumic acid (salt), and the like. However, most of these conventional charge controlling agents have disadvantages that they are blackish materials, that they have poor compatibility or wetting property with a binder resin, or that their charge controlling properties do not remain long because of a subliming property. Thus, most of them are unsuitable as a charge controlling agent for a color toner of electrophotography. Recently, a demand for producing a multicolor copy from a multicolor original has been increased year by year, but these conventional charge controlling agents can not satisfy this demand because of the above mentioned disadvantages. A toner containing these conventional charge controlling agents has favourable developing properties at the initial stage, but its life is short and environmental stability is poor (stability to the changes of temperature and moisture is poor). Therefore, there are defects that the density of a copied image is lowered and that fog, stain and the like appear on a copy paper.

The above mentioned conventional coloring agents and charge controlling agents are disclosed in Japanese Patent Publication Nos. 48-25941, 48-26784, 49-20225, 46-43440, 48-30899, 49-46423 and 49-26909, and Japanese Patent Laid Open Nos. 50-140137, 50-142037, 50-142038, 49-51949, 49-134303 and 60-46566.

SUMMARY OF THE INVENTION

The first object of the present invention is to provide a color toner for electrophotography, which does not cause fog and edge effect but produces an even image density. The second object of the present invention is to provide a color toner having an excellent durability and environmental stability suitable for one-component type or two-component type dry type developer used for high speed development. The third object of the present invention is to provide a dry type color toner which is not influenced by temperature and moisture conditions and which does not cause "off set" phenomenon.

That is, an object of the present is to provide a color toner for electrophotography containing a yellow coloring agent and a binder resin as the main components, said coloring agent comprising at least one of the anthraquinone derivatives expressed by the following general formula (I),

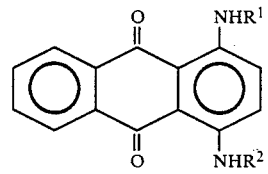

(I)

wherein $R^1$ represents hydrogen or an alkyl group having at least 6 carbon atoms and $R^2$ represents hydrogen, an alkyl group having at least 6 carbon atoms or phenyl group.

Another object of the present invention is to provide a color toner for electrophotography containing a coloring agent and a binder resin as the main components, said coloring agent comprising a combination of at least one of the anthraquinone derivatives expressed by the following general formula (I),

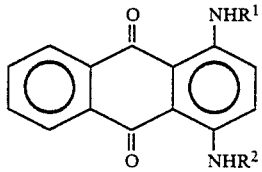

(I)

wherein $R^1$ represents hydrogen or an alkyl group having at least 6 carbon atoms and $R^2$ represents hydrogen, an alkyl group having at least 6 carbon atoms or phenyl group, with at least one of the compounds expressed by the following chemical formulas (II) and (III):

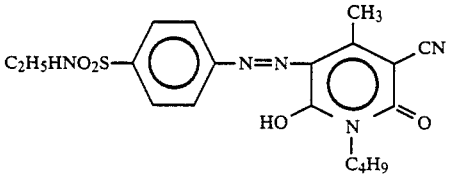

(II)

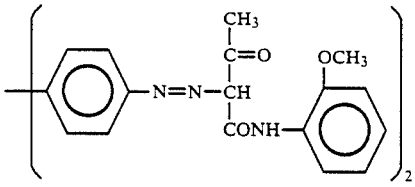

(III)

DETAILED DESCRIPTION OF THE INVENTION

The basic toner of the present invention contains a coloring agent and a binder resin as the main components, said coloring agent comprising at least one of the anthraquinone derivatives expressed by the following general formula (I),

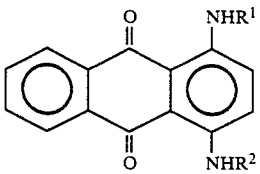

(I)

wherein $R^1$ represents hydrogen or an alkyl group having at least 6 carbon atoms, preferably 7 to 12 carbon atoms, and $R^2$ represents hydrogen, an alkyl group having at least 6 carbon atoms, preferably 7 to 12 carbon atoms, or phenyl group. The toner containing the compound of said general formula (I) as a single coloring agent provides a blue toner.

Another toner of the present invention contains a coloring agent and a binder resin as the main components, said coloring agent comprising a combination of at least one of the blue type coloring agents expressed by the following general formula (I),

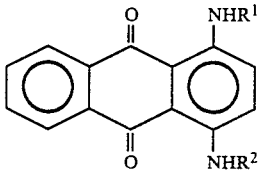

(I)

wherein $R^1$ represents hydrogen or an alkyl group having at least 6 carbon atoms, and $R^2$ represents hydrogen, an alkyl group having at least 6 carbon atoms, or phenyl group, with at least one of the yellow type coloring agents compounds expressed by the following chemical formulas (II) and (III):

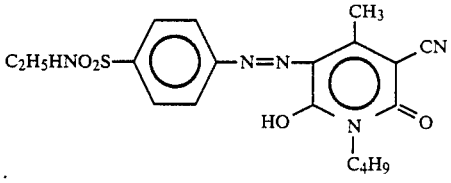

(II)

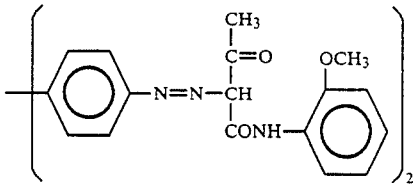

(III)

The above mentioned combination of the coloring agents provides a green toner. Thus, the coloring agent of said general formula (I) is blue, and the coloring agent of the chemical formula (II) (C.I. Solvent Yellow 162) and the coloring agent of the chemical formula (III) (C.I. Pigment Yellow 17) are yellow. The mixture of these two types of coloring agents makes green color.

Conventionally known green toners were prepared by using a green coloring agent such as phthalocyanine green, triphenyl methane type dyes and pigments, or a mixture of a blue coloring agent such as phthalocyanine type, triphenyl methane type, indanthrone type dyes and pigments with a yellow coloring agent such as azo type dyes and pigments. However, the toners prepared by using these conventional coloring agents have such disadvantages as that toner filming easily occurs on a photosensitive material; that the ground of a copy paper is severely stained after developing for a long time; and that the image density varies depending on environmental conditions such as temperature and moisture.

However, we have discovered that the above mentioned conventional disadvantages can be removed by using the specific coloring agent of said general formula (I) for a blue toner or by using a combination of the specific coloring agent of said general formula (I) with at least one of the coloring agents of the chemical formulas (II) and (III). The present invention is based on this discovery.

Examples of the anthraquinone derivatives expressed by the general formula (I) used as a coloring agent in the present invention include as follows:

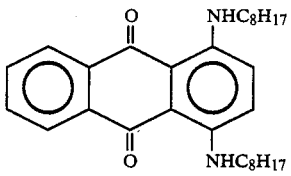

(No. 1)

(C.I. Solvent Blue 111)

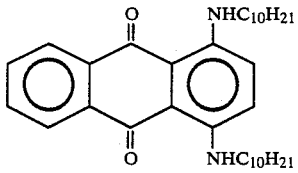

(No. 2)

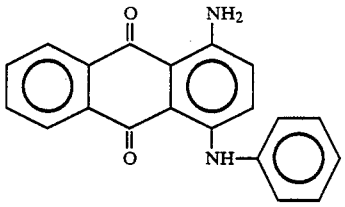

(No. 3)

(C.I. Solvent Blue 68)

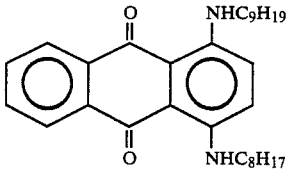

(No. 4)

These coloring agents (anthraquinone derivatives) may be used alone or in a mixture of two or more.

In the preparation of a blue toner in accordance with the present invention, the coloring agent is used in an amount of 0.1 to 30 parts by weight, preferably 0.5 to 10 parts by weight per 100 parts by weight of a binder resin. If the amount of the coloring agent is smaller than the above mentioned range, the blue coloring effect becomes unsatisfactory. On the other hand, if the amount of the coloring agent is larger than the above mentioned range, the fixativity becomes poor.

In the preparation of a green toner in accordance with the present invention, both of the above mentioned yellow type coloring agents of the chemical formulas (II) and (III) (C.I. Solvent Yellow 162 and C.I. Pigment Yellow 17) may be used at the same time. In the preparation of a green type toner, the blue coloring agent of the general formula (I) is mixed with the yellow type coloring agent (C.I. Solvent Yellow 162 and/or C.I. Pigment Yellow 17) in a mixing weight ratio of 2:8~8:2. If the two types coloring agents are mixed in a ratio of outside of the above mentioned mixing ratio range, a color tone of green is lost. The coloring agents (the total of the blue and yellow coloring agents) are used in an amount of 0.5 to 30 parts by weight, preferably 1 to 20 parts by weight per 100 parts by weight of a binder resin. If the amount of the coloring agents is smaller than the above mentioned range, the green coloring effect becomes unsatisfactory. On the other hand, if the amount of the coloring agents is larger than the above mentioned range, the fixativity becomes poor.

We have variously studied the charge controlling properties of a dry type toner, and found that metal salts (particularly zinc salt and chromium salt) of salicylic acid and metal salts (particularly zinc salt and chromium salt) of salicylic acid derivatives are very effective as a charge controlling agent. Thus, we have found that quite satifactory toner can be obtained when using the above mentioned specific coloring agents in combination with the above mentioned charge controlling agent.

The metal salts of salicylic acid or its derivatives used as a charge controlling agent is expressed by the following general formula (IV),

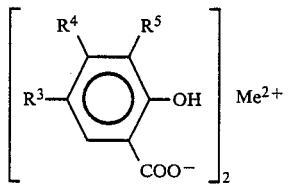

(IV)

wherein $R^3$, $R^4$ and $R^5$ represent hydrogen, an aryl group or an alkyl group having 1 to 10 carbon atoms. $R^3$, $R^4$ and $R^5$ may be the same or different and Me represents any metal selected from the group consisting of zinc, nickel, cobalt, copper and chromium. Among them, zinc salt and chromium salt are preferble.

The metal salts as expressed by the above general formula can be easily synthesized by the method disclosed in "J. Amer. Chem. Soc." 70, 2151 by CLARK, J. L. Kao, H. (1948). For example, zinc salt of salicylic acid or salicylic acid derivatives can be produced by mixing 2 moles of sodium salicylate (or sodium salt of salicylic acid derivatives) with one mole of zinc chloride and stirring the resultant mixture in the presence of heat. The metal salt thus obtained is a white crystal and does not damage the color of a coloring agent when dispersed in a toner binder. Metal salts other then zinc salt can be produced in the same manner as mentioned above. These metal salts may be used alone or in a mixture of two or more.

Said metal salt is used in an amount of 0.1 to 10 parts by weight, preferably 0.5 to 7 parts by weight, per 100 parts by weight of a binder resin.

The blue toner of the present invention comprises the coloring agent of said general formula (I) as the essential components and preferably further contains the above mentioned charge controlling agent of said general formula (IV).

In addition to the essential coloring agent of the general formula (I), other coloring agents of its affiliated color (blue) may be added thereto in some amount.

The green toner of the present invention comprises the essential combination of the blue coloring agent of said general formula (I) with C.I. Solvent Yellow 162 of said chemical formula (II) and/or C.I. Pigment Yellow 17 of said chemical formula (III) as the essential components and preferably further contains the above mentioned charge controlling agent of said general formula (IV).

In addition to the essential coloring agents of the general formula (I), and of the chemical formulas (II) and/or (III), other coloring agents of its affiliated colors (blue, yellow and green) may be added thereto in some amount.

Any of the conventional binder resins can be used as a binder resin for the toner of the present invention, examples of which include styrene type resins (for example, polystyrene, styrene-acrylic acid copolymer, styrene-methacrylic acid copolymer, styrene-acrylate copolymer, styrene-methacrylate copolymer, styrene-butadiene copolymer, and the like), saturated polyester resin, unsaturated polyester resin, epoxy resin, phenolic resin, maleic acid resin, coumarone resin, chlorinated paraffin, xylene resin, vinyl chloride type resin, polypropylene, polyethylene, and the like. These resins may be used alone or in a mixture of two or more.

However, among the above mentioned resins, polystyrene, styrene type resin, and epoxy type resin are preferable.

In addition to the above components, the toner of the present invention may further contain additives, for example, a plasticizer such as dibutyl phthalate, dioctyl phthalate and the like for the purposes of controlling thermal property, electric property, physical property and the like of the toner and a resistance modifier such as tin oxide, lead oxide, antimony oxide and the like.

After preparing toner particles (5 to 20 μm), the toner of the present invention may further contain a fluidity improver such as powdery $TiO_2$, $Al_2O_3$, $SiO_2$ and the like for improving the fluidity of the toner by coating the surface of the toner particles with these powders, and an agent for preventing the degradation of photosensitive material such as zinc stearate, phthalic acid and the like.

The toner of the present invention is preferably used as a two-component type developer by mixing with a carrier. However, the toner of the present invention can be used as a one-component type developer for "touch down" system or may be used as a normal one-component type developer by dispersing magnetic material (magnetite powder and the like) in the toner.

The carrier used in this invention may be prepared by coating at least one core material having a particle size of 50 to 300 μm selected from the group of iron powder, nickel powder, ferrite powder, glass powder and the like, with at least one selected from the group of styrene-acrylate copolymer, styrene-methacrylate copolymer, acrylate polymer, methacrylate polymer, silicone resin, polyamide resin, ionomer resin, polyphenylene sulfide resin, their mixture, and a dispersion having an electroconductive powder dispersed in at least one of these resins.

A carrier is mixed with a toner generally in an amount of 10 to 1,000 parts by weight per one part by weight of toner.

A dry type toner prepared by using the compound of the general formula (I) in which the carbon number of $R^1$ and $R^2$ groups is made not more than 5, as a charge controlling agent (Japanese Patent Publication No. 5742860) or a coloring agent, is not satisfactory. This is proved by the following comparative Examples. That is, it is the essential feature of the present invention that the carbon number of $R^1$ and $R^2$ groups should be at least 6.

The present invention is further illustrated by the following Examples and Comparative Examples. All the parts used herein mean parts by weight.

EXAMPLE 1

Styrene-n-butylmethacrylate copolymer: 100 parts
The above listed No. 3 anthraquinone dye: 8 parts
(Orasett Blue 2R manufactured by Ciba-Geigy Corp.)
zinc salicylate: 8 parts The above components were melt-kneaded in a hot roll mill. After cooling the kneaded mixture, the mixture was roughly ground by a hammer mill and further finely pulverized by a powdering machine employing air jet system. The pulverized powder was classified into particles having a particle size of 5 to 20 μm, thus producing a blue toner of the present invention. 3.5 parts of this toner was mixed with 100 parts of a carrier (spherical ferrite powder of a particle size of about 100 μm coated with silicone resin in a coating thickness of about 1 μm) to prepare a two-component dry type developer.

A copy was made using the above prepared developer by a dry type electrophotographic copier (Ricopy FT5050 manufactured by Ricoh Co.) under the environmental conditions of 10° C., 15% relative humidity; 20° C., 60% relative humidity; and 30° C., 90% relative humidity. As this result, a clear blue toner image having no fog was produced. Even after continuously making 20,000 copies, the quality of the copies was not lowered. The electrified amount of this developer measured by Blow-off Method was 16 μc/g.

The same test was repeated as mentioned above, except that chromium salicylate was used in place of said zinc salicylate as a charge controlling agent, but a satisfactory result was obtained in substantially the same manner as in the case of using the zinc salt.

COMPARATIVE EXAMPLE 1

A comparative developer was prepared in the same manner as in Example 1, except that the anthraquinone dye was replaced by phthalocyanine pigment (Lionol Blue KL).

A copy was made using the above prepared comparative developer under the environmental conditions of 10° C., 15% relative humidity; 20° C., 60% relative humidity; and 30° C., 90% relative humidity; thus producing a copy of blue color tone image and the electrified amount being satisfactorily 14 μc/g. However, at the stage of making 7,000 copies, the ground of copy paper began to be stained.

EXAMPLE 2

A developer was prepared in the same manner as in Example 1, except that the binder resin was replaced by styrene-acrylic acid copolymer.

A copy was made using the above prepared developer under the environmental conditions of 10° C., 15% relative humidity; 20° C., 60% relative humidity; and 30° C., 90% relative humidity, thus producing a copy of blue toner image having no fog. Even after making 20,000 copies, the copy quality was not lowered. The electrified amount was 14 μc/g.

EXAMPLE 3

Styrene-n-butylmethacrylate copolymer 100 parts

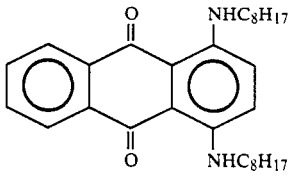

5 parts zinc salicylate 3 parts

The above components were melt-kneaded in a hot roll mill. After cooling the kneaded mixture, the mixture was roughly ground by a hammer mill and further finely pulverized by a powdering machine employing air jet system. The pulverized powder was classified into particles having a particle size of 5 to 20 μm, thus producing a blue toner of the present invention. 3.5 parts of this toner was mixed with 100 parts of spherical ferrite powder of a particle size of 100 μm coated with silicone resin to prepare a two-component dry type developer.

A copy was made using the above prepared developer by a dry type electrophotographic copier (Ricopy FT5050 manufactured by Ricoh Co.) under the environmental conditions of 10° C., 15% relative humidity; 20° C., 60% relative humidity; and 30° C., 90% relative humidity. As this result, a clear blue toner image having no fog was produced. Even after continuously making 50,000 copies, the quality of the copies was not lowered. The results of image density (measured by Macbeth density meter), the state of being stained, and color tone at the initial stage and the stage of after making 2,000 copies are shown in the following Table-1.

EXAMPLE 4

A developer was prepared in the same manner as in Example 3, except that the coloring agent was replaced by the following material:

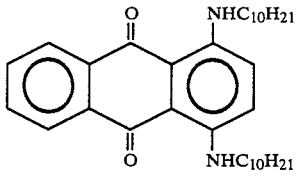

A copy was made using the above prepared developer by a dry type electrophotographic copier (Ricopy FT5050 manufactured by Ricoh Co.) under the environmental conditions of 10° C., 15% relative humidity; 20° C., 60% relative humidity; and 30° C., 90% relative humidity. As this result, a clear blue toner image having no fog was produced. Even after continuously making 20,000 copies, the quality of the copies was not lowered. The results of image density, the state of being stained, and color tone at the initial stage and the stage of after making 2,000 copies are shown in the following Table-1.

COMPARATIVE EXAMPLE 2

A comparative developer was prepared in the same manner as in Example 3, except that the coloring agent was replaced by phthalocyanine type blue pigment (Lionol Blue KL). A copy was made in the same manner using the above prepared comparative developer, thus producing a copy of blue color tone image. However, at the stage of making 7,000 copies, the ground of copy paper began to be stained. The results of image density, the state of being stained, and color tone at the initial stage and the stage of after making 2,000 copies are shown in the following Table-1.

COMPARATIVE EXAMPLE 3

A comparative developer was prepared in the same manner as in Example 3, except that the coloring agent was replaced by the following material:

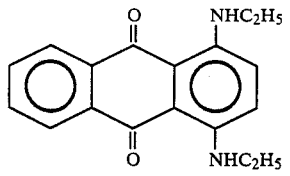

However, during kneading, the coloring material was melted, and therefore it was not sufficiently dispersed in the binder resin. Consequently, the developed color tone was unclear, and the image density was low, the ground of copy paper being stained. The results of image density, the state of being stained, and color tone at the initial stage and the stage of after making 2,000 copies are shown in the following Table-1.

EXAMPLE 5

A developer was prepared in the same manner as in Example 3, except that the coloring agent was replaced by the following material:

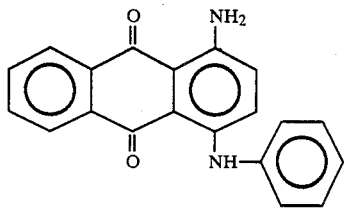

A copy was made in the same manner as in Example 3, and substantially the same effect could be achieved.

The results of image density, the state of being stained, and color tone at the initial stage and the stage of after making 2,000 copies are shown in the following Table-1.

COMPARATIVE EXAMPLE 4

A comparative developer was prepared in the same manner as in Example 3, except that the coloring agent was replaced by the following material:

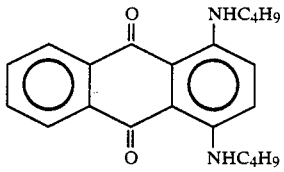

The same procedure was repeated as in Example 3, but satifactory results could not be obtained in the same manner as in Comparative Example 3.

The results of image density, the state of being stained, and color tone at the initial stage and the stage of after making 2,000 copies are shown in the following Table-1.

TABLE 1

| | Initial Stage | | After making 20,000 copies | | |
|---|---|---|---|---|---|
| | Image Density | Stained state of copy paper | Image Density | Stained state of copy paper | Color Tone |
| Example 3 | 1.35 | no stain | 1.34 | no stain | clear |
| Example 4 | 1.40 | no stain | 1.39 | no stain | clear |

TABLE 1-continued

| | Initial Stage | | After making 20,000 copies | | |
|---|---|---|---|---|---|
| | Image Density | Stained state of copy paper | Image Density | Stained state of copy paper | Color Tone |
| Example 5 | 1.41 | no stain | 1.40 | no stain | clear |
| Comparative Ex. 2 | 1.35 | no stain | 1.00 | stained | clear |
| Comparative Ex. 3 | 0.69 | stained | 0.59 | stained | unclear |
| Comparative Ex. 4 | 0.75 | stained | 0.60 | stained | unclear |

EXAMPLE 6

Styrene-n-butylmethacrylate copolymer: 100 parts
The above listed No. 1 blue coloring agent: 5 parts
C.I. Solvent Yellow 162: 5 parts
zinc salicylate: 3 parts The above components were melt-kneaded in a hot roll mill. After cooling the kneaded mixture, the mixture was roughly ground by a hammer mill and further finely pulverized by a powdering machine employing air jet system. The pulverized powder was classified into particles having a particle size of 3 to 25 μm, thus producing a green toner of the present invention. 3.5 parts of this toner was mixed with 100 parts of a carrier (spherical ferrite powder of a particle size of about 100 μm coated with silicone resin in a coating thickness of about 1 μm) to prepare a two-component dry type developer.

A copy was made using the above prepared developer by a dry type electrophotographic copier (Ricopy FT5050 manufactured by Ricoh Co.) under the environmental conditions of 10° C., 15% relative humidity; 20° C., 60% relative humidity; and 30° C., 90% relative humidity. As this result, a clear green toner image having no fog and no ground stain was produced. Even after continuously making 20,000 copies, the quality of the copies was not lowered. The image density measured by a Macbeth density meter was 1.35 at the initial stage and 1.36 after making 20,000 copies. The electrified amount measured by Blow-off Method was −17.0 μc/g at the initial stage and −17.1 μc/g after making 20,000 copies.

The same test was repeated as mentioned above, except that chromium salicylate was used in place of said zinc salicylate as a charge controlling agent, but a satisfactory result was obtained in substantially the same manner as in the case of using the zinc salt.

COMPARATIVE EXAMPLE 5

A comparative developer was prepared in the same manner as in Example 6, except that the above listed No. 1 blue coloring agent was replaced by phthalocyanine type blue pigment (Lionol Blue KL manufactured by Toyo Ink Co.).

A copy was made using the above prepared comparative developer by a dry type electrophotographic copier (Ricopy FT5050 manufactured by Ricoh Co.) under the environmental conditions of 10° C., 15% relative humidity; 20° C., 60% relative humidity; and 30° C., 90% relative humidity, thus producing a copy of green color tone image. However, at the stage of making 7,000 copies, the ground of copy paper began to be stained.

The image density was 1.21 at the initial stage and 1.01 after making 20,000 copies. The electrified amount of the toner was −12.0 μc/g at the initial stage and −5.5 μc/g after making 20,000 copies.

COMPARATIVE EXAMPLE 6

A comparative developer was prepared in the same manner as in Example 6, except that said No. 1 blue coloring agent was replaced by the following material:

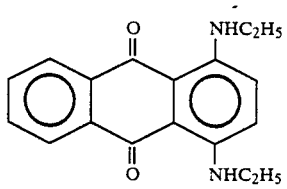

However, during kneading, the coloring material was melted, and therefore it was not sufficiently dispersed in the binder resin. Consequently, the developed color tone was unclear, and the image density was low, the ground of copy paper being stained.

A copy was made using the above prepared comparative developer by a dry type electrophotographic copier (Ricopy FT5050 manufactured by Ricoh Co.) under the environmental conditions of 10° C., 15% relative humidity; 20° C., 60% relative humidity; and 30° C., 90% relative humidity, thus producing a copy of green color tone image. However, at the stage of making 7,000 copies, the ground of copy paper began to be stained. The electrified amounts of this toner (at the initial stage and after making 20,000 copies) were almost the same as in Comparative Example 5.

EXAMPLE 7

A developer was prepared in the same manner as in Example 6, except that the binder resin was replaced by styrene-acrylic acid copolymer (SBM-73 manufactured by Sanyo Kasei Co.).

A copy was made using the above prepared developer by a dry type electrophotographic copier (Ricopy FT5050 manufactured by Ricoh Co.) under the environmental conditions of 10° C., 15% relative humidity; 20° C., 60% relative humidity; and 30° C., 90% relative humidity. As this result, a satisfacory green toner image having no ground stain was produced. Even after continuously making 20,000 copies, the quality of the copies was not lowered.

EXAMPLE 8

A developer was prepared in the same manner as in Example 6, except that C.I. Solvent Yellow 162 was replaced by C.I. Pigment Yellow 17.

A copy was made using the above prepared comparative developer by a dry type electrophotographic copier (Ricopy FT5050 manufactured by Ricoh Co.) under the environmental conditions of 10° C., 15% relative humidity; 20° C., 60% relative humidity; and 30° C., 90% relative humidity, thus producing a copy of green toner image having no ground stain. Even after continuously making 20,000 copies, the quality of the copies was not lowered. The image density was 1.36 at the initial stage and 1.37 after making 20,000 copies. The electrified amount of the toner was −15.5 μc/g at the initial stage and −15.9 μc/g after making 20,000 copies.

EXAMPLE 9

A developer was prepared in the same manner as in Example 6, except that the blue coloring agent was replaced by the above listed No. 2 coloring agent.

A copy was made using the above prepared comparative developer by a dry type electrophotographic copier (Ricopy FT5050 manufactured by Ricoh Co.) under the environmental conditions of 10° C., 15% relative humidity; 20° C., 60% relative humidity; and 30° C., 90% relative humidity, thus producing a copy of green toner image having no ground stain. Even after continuously making 20,000 copies, the quality of the copies was not lowered. The image density was 1.38 at the initial stage and 1.49 after making 20,000 copies. The electrified amount of the toner was −16.0 μc/g at the initial stage and −16.5 μc/g after making 20,000 copies.

EXAMPLE 10

A developer was prepared in the same manner as in Example 6, except that the blue coloring agent was replaced by the above listed No. 3 coloring agent.

20,000 copies were continuously made using the above prepared comparative developer by a dry type electrophotographic copier (Ricopy FT5050 manufactured by Ricoh Co.) under the environmental conditions of 10° C., 15% relative humidity; 20° C., 60% relative humidity; and 30° C., 90% relative humidity. As this result, a satisfactory copy of green toner image having no ground stain was produced. The electrified amounts of this toner (at the initial stage and after making 20,000 copies) were almost the same as in Example 6.

COMPARATIVE EXAMPLE 7

A comparative developer was prepared in the same manner as in Example 6, except that C.I. Solvent Yellow 162 was replaced by C.I. Pigment Yellow 12, and a copy was made using this comparative developer in the same manner as in Example 6. However, at the stage of making 5,000 copies, the ground of copy paper began to be stained. The image density was 1.20 at the initial stage and 0.96 after making 20,000 copies. The electrified amount of the toner was −10.0 μc/g at the initial stage and −4.8 μc/g after making 20,000 copies.

As can be seen from the above Examples, the blue toner containing the specific coloring agent expressed by the general formula (I), and the green toner containing a mixture of said coloring agent of the general formula (I) with the coloring agents expressed by the chemical formulas (II) and/or (III), provide a highly colored and clear color image by the use of a small amount of these coloring agents. Moreover, these toners of the present invention are not influenced by temperature and moisture conditions, and are very useful for producing a large number of copies.

What we claim is:

1. A color toner for electrophotography containing a coloring agent and a binder resin as the main components, said coloring agent comprising at least one of the anthraquinone derivatives having the formula (I),

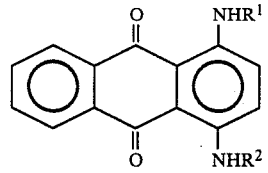

(I)

wherein $R^1$ represents hydrogen or alkyl having at least 6 carbon atoms and $R^2$ represents hydrogen, alkyl having at least 6 carbon atoms or phenyl.

2. The color toner as claimed in claim 1, wherein said coloring agent of the formula (I) is at least one selected from the group consisting of:

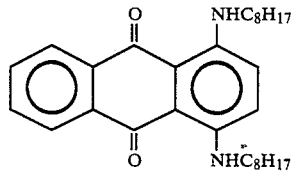

(No. 1)

(C.I. Solvent Blue 111)

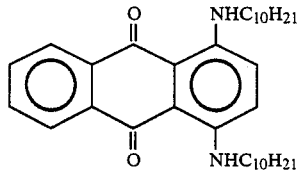

(No. 2)

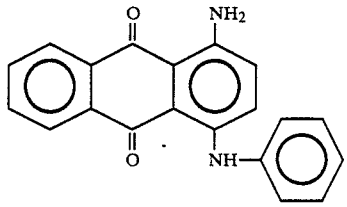

(No. 3)

(C.I. Solvent Blue 68)

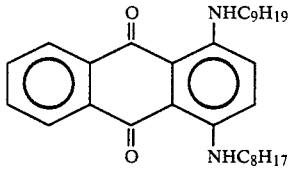

(No. 4)

3. The color toner as claimed in claim 1, wherein said coloring agent is contained in an amount of 0.1 to 30 parts by weight per 100 parts by weight of said binder resin.

4. The color toner as claimed in claim 3, wherein said coloring agent is contained in an amount of 0.5 to 10 parts by weight per 100 parts by weight of said binder resin.

5. The color toner as claimed in claim 3, wherein said coloring agent is contained in an amount of 1 to 7 parts by weight per 100 parts by weight of said binder resin.

6. The color toner as claimed in claim 1, wherein said color toner further contains at least one charge controlling agent selected from the group consisting of metal salts of salicylic acid and salicylic acid derivatives having the following formula (IV),

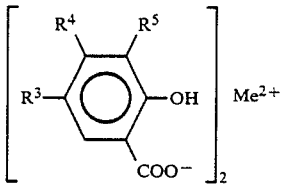
(IV)

wherein $R^3$, $R^4$ and $R^5$ represent hydrogen, aryl or alkyl having 1 to 10 carbon atoms, and Me represents a metal selected from the group consisting of zinc, nickel, cobalt, copper and chromium.

7. The color toner as claimed in claim 6, wherein said charge controlling agent is a zinc salt of salicylic acid or a derivative thereof.

8. The color toner as claimed in claim 6, wherein said charge controlling agent is contained in an amount of 0.1 to 10 parts by weight per 100 parts by weight of said binder resin.

9. The color toner as claimed in claim 1, wherein said binder resin is at least one selected from the group consisting of polystyrene, styrene-acrylic acid copolymer, styrene-methacrylic acid copolymer, styrene-acrylate copolymer, styrene-methacrylate copolymer, styrene-butadiene copolymer, saturated polyester resin, unsaturated polyester resin, epoxy resin, phenolic resin, maleic acid resin, coumarone resin, chlorinated paraffin, xylene resin, vinyl chloride resin, polypropylene and polyethylene.

10. The color toner as claimed in claim 1, wherein said color toner is mixed with a carrier prepared by coating at least one core material selected from the group consisting of iron powder, nickel powder, ferrite powder, and glass powder with at least one coating resin selected from the group consisting of styrene-acrylate copolymer, styrene-methacrylate copolymer, acrylate polymer, methacrylate polymer, silicone resin, polyamide resin, ionomer resin, polyphenylene sulfide resin, mixture thereof, and a dispersion having an electroconductive powder dispersed in at least one of said coating resins.

11. The color toner as claimed in claim 1, wherein said toner further contains at least one additive selected from the group consisting of (i) as a plasticizer, dibutyl phthalate and dioctyl phthalate (ii) as a resistance modifier, tin oxide, zinc oxide and antimony oxide, (iii) as a fluidity improver, $TiO_2$, $Al_2O_3$ and $SiO_2$ and (iv) as an agent for preventing the degradation of photosensitive material, zinc stearate and phthalic acid.

12. The color toner as claimed in claim 1, wherein, in addition to said anthraquinone derivatives of the general formula (I), said coloring agent further comprises at least one of the compounds having the formulas (II) and (III):

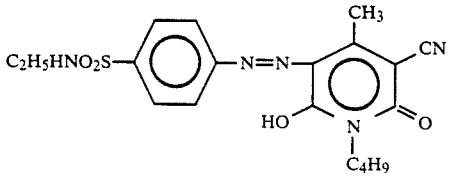
(II)

-continued

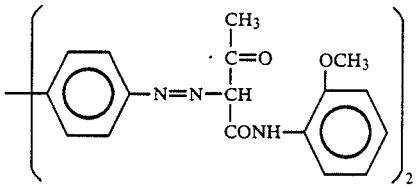
(III)

13. The color toner as claimed in claim 12, wherein the mixing weight ratio of said anthraquinone derivatives of the formula (I) to said compounds of the formulas (II) and/or (III) is from 2:8 to 8:2.

14. The color toner as claimed in claim 12, wherein said coloring agent of the formula (I) is at least one selected from the group consisting of:

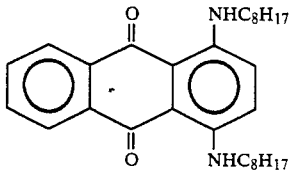
(No. 1)

(C.I. Solvent Blue 111)

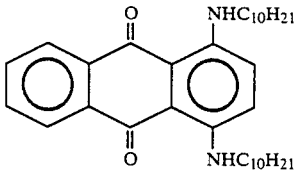
(No. 2)

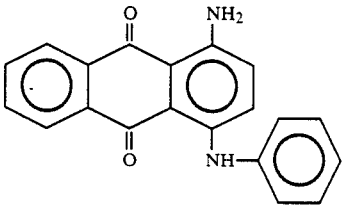
(No. 3)

(C.I. Solvent Blue 68)

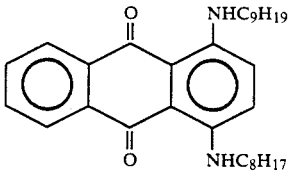
(No. 4)

15. The color toner as claimed in claim 12, wherein the total amount of said coloring agent is 0.5 to 30 parts by weight per 100 parts by weight of said binder resin.

16. The color toner as claimed in claim 15, wherein the total amount of said coloring agent is 1 to 20 parts by weight per 100 parts by weight of said binder resin.

17. The color toner as claimed in claim 16, wherein the total amount of said coloring agent is 1 to 7 parts by weight per 100 parts by weight of said binder resin.

18. The color toner as claimed in claim 12, wherein said color toner further contains at least one charge controlling agent selected from the group consisting of metal salts of salicylic acid and salicylic acid derivatives expressed by the formula (IV), (IV)

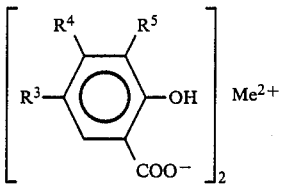

wherein $R^3$, $R^4$ and $R^5$ represent hydrogen, aryl or alkyl having 1 to 10 carbon atoms and Me represents metal selected from the group consisting of zinc, nickel, cobalt, copper and chromium.

19. The color toner as claimed in claim 18, wherein said charge controlling agent is a zinc salt of salicylic acid or derivative thereof.

20. The color toner as claimed in claim 18, wherein said charge controlling agent is contained in an amount of 0.1 to 10 parts by weight per 100 parts by weight of said binder resin.

21. The color toner as claimed in claim 12, wherein said binder resin is at least one selected from the group consisting of polystyrene, styrene-acrylic acid copolymer, styrene-methacrylic acid copolymer, styrene-acrylate copolymer, styrene-methacrylate copolymer, styrene-butadiene copolymer, saturated polyester resin, unsaturated polyester resin, epoxy resin, phenolic resin, maleic acid resin, coumarone resin, chlorinated paraffin, xylene resin, vinyl chloride resin, polypropylene and polyethylene.

22. The color toner as claimed in claim 12, wherein said color toner is mixed with a carrier prepared by coating at least one core material selected from the group consisting of iron powder, nickel powder, ferrite powder, and glass powder with at least one coating resin selected from the group consisting of styrene-acrylate copolymer, styrene-methacrylate copolymer, acrylate polymer, methacrylate polymer, silicone resin, polyamide resin, ionomer resin, polyphenylene sulfide resin, mixture thereof, and a dispersion having an electroconductive powder dispersed in said coating resins.

23. The color toner as claimed in claim 12, wherein said toner further contains at least one additive selected from the group consisting of (i) as a plasticizer, dibutyl phthalate and dioctyl phthalate, (ii) as a resistance modifier, tin oxide, lead oxide and antimony oxide, (iii) as a fluidity improver, $TiO_2$, $Al_2O_3$ and $SiO_2$, and (iv) as an agent for preventing the degradation of photosensitive material, zinc stearate, and phthalic acid.

* * * * *